US009745649B2

(12) United States Patent
Osaki et al.

(10) Patent No.: US 9,745,649 B2
(45) Date of Patent: Aug. 29, 2017

(54) HEAT-RESISTING STEEL FOR EXHAUST VALVES

(75) Inventors: Mototsugu Osaki, Aichi (JP); Shigeki Ueta, Aichi (JP); Takashi Tsuyumu, Saitama (JP)

(73) Assignees: DAIDO STEEL CO., LTD., Aichi (JP); HONDA MOTOR CO., LTD., Tokyo (JP)

( * ) Notice: Subject to any disclaimer, the term of this patent is extended or adjusted under 35 U.S.C. 154(b) by 47 days.

(21) Appl. No.: 14/240,187

(22) PCT Filed: Aug. 24, 2012

(86) PCT No.: PCT/JP2012/071511

§ 371 (c)(1),
(2), (4) Date: Feb. 21, 2014

(87) PCT Pub. No.: WO2013/027841

PCT Pub. Date: Feb. 28, 2013

(65) Prior Publication Data

US 2014/0212321 A1 Jul. 31, 2014

(30) Foreign Application Priority Data

Aug. 24, 2011 (JP) ..... 2011-182987
May 16, 2012 (JP) ..... 2012-112238

(51) Int. Cl.

| | |
|---|---|
| ***C22C 38/58*** | (2006.01) |
| ***C22C 38/02*** | (2006.01) |
| ***C22C 38/06*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |
| ***C22C 38/00*** | (2006.01) |
| ***C21D 6/00*** | (2006.01) |
| ***C21D 9/00*** | (2006.01) |
| *F01L 3/02* | (2006.01) |

(52) U.S. Cl.

CPC ..... *C22C 38/58* (2013.01); *C21D 6/004* (2013.01); *C21D 9/0068* (2013.01); *C22C 38/001* (2013.01); *C22C 38/002* (2013.01); *C22C 38/02* (2013.01); *C22C 38/06* (2013.01); *C22C 38/44* (2013.01); *C22C 38/48* (2013.01); *C22C 38/50* (2013.01); *C22C 38/54* (2013.01); *F01L 3/02* (2013.01)

(58) Field of Classification Search

CPC ..... C22C 38/58; C22C 38/001; C22C 38/002; C22C 38/02; C22C 38/06; C22C 38/44; C22C 38/48; C22C 38/50; C22C 38/54; C21D 6/004; C21D 9/0068; F01L 3/02

See application file for complete search history.

(56) References Cited

U.S. PATENT DOCUMENTS

| | | | | |
|---|---|---|---|---|
| 4,929,419 | A * | 5/1990 | Wegman | C22C 38/58 148/326 |
| 5,064,610 | A | 11/1991 | Sato et al. | |
| 2004/0184946 | A1 | 9/2004 | Tominaga et al. | |

FOREIGN PATENT DOCUMENTS

| | | | | |
|---|---|---|---|---|
| CN | 1118381 | | 3/1996 | |
| EP | 2 371 980 | | 10/2011 | |
| JP | 55-002775 | | 1/1980 | |
| JP | 63-210260 | | 8/1988 | |
| JP | 03-285050 | | 12/1991 | |
| JP | 06-017198 | | 1/1994 | |
| JP | 09-279309 | | 10/1997 | |
| JP | 2001-323323 | | 11/2001 | |
| JP | 2001-323323 | A * | 11/2001 | C22C 38/00 |
| JP | 2004-277860 | | 10/2004 | |
| JP | 2010-280950 | | 12/2010 | |
| JP | 2011-219864 | | 11/2011 | |

OTHER PUBLICATIONS

JP Pub. No. 06-017198, Published Jan. 25, 1994, Machine translation.*

Tokoro et al., JP 03-285050, published Dec. 1991. (machine translation).*

Chinese Office Action for CN 201280041280.X, dated Feb. 27, 2015, along with an English translation thereof.

International Search Report for Application No. PCT/JP2012/071511, which was mailed on Oct. 2, 2012.

English translation of the Written Opinion of the International Searching Authority for PCT/JP2012/071511, which was issued on Feb. 25, 2014.

Extended European Search Report issued in Patent Application No. 12825948.8, dated Jan. 25, 2016.

* cited by examiner

*Primary Examiner* — Jessee Roe
*Assistant Examiner* — John Hevey
(74) *Attorney, Agent, or Firm* — Greenblum & Bernstein, P.L.C.

(57) ABSTRACT

The object of the present invention is to provide a heat-resistant steel for exhaust valves, having relatively small Ni content, high mechanical characteristics (for example, tensile strength, fatigue strength, wear resistance and hardness) at high temperature, and excellent oxidation resistance. The present invention provides a heat-resistant steel for exhaust valves, which includes: $0.45 \leq C < 0.60$ mass %, $0.30 < N < 0.50$ mass %, $19.0 \leq Cr < 23.0$ mass %, $5.0 \leq Ni < 9.0$ mass %, $8.5 \leq Mn < 10.0$ mass %, $2.5 \leq Mo < 4.0$ mass %, $0.01 \leq Si < 0.50$ mass %, and $0.01 \leq Nb < 0.30$ mass %, with the balance being Fe and unavoidable impurities, in which the steel satisfies $0.02 \leq Nb/C < 0.70$ and satisfies $4.5 \leq Mo/C < 8.9$.

8 Claims, 2 Drawing Sheets

HEAT-RESISTING STEEL FOR EXHAUST VALVES

TECHNICAL FIELD

The present invention relates to a heat-resistant steel for exhaust valves.

BACKGROUND OF THE INVENTION

An intake valve for introducing mixed gas of fuel and air into a cylinder and an exhaust valve for discharging combustion gas outside the cylinder are used in an engine. Among these, since the exhaust valve is exposed to combustion gas having high temperature, a material having high temperature characteristics (for example, high temperature hardness, fatigue properties, high temperature strength, wear resistance and oxidation resistance) is used in the exhaust valve. Ni-based superalloy (for example, NCF751), austenitic heat-resistant steel (for example, SUH35) and the like are known as a material for exhaust valves.

Ni-based superalloy is a material in which γ' phase has been precipitated by aging treatment, thereby enhancing strength at high temperature and wear resistance. The Ni-based superalloy is expensive, but has extremely high heat resistance. For this reason, a valve using this is mainly used in high output engines that are exposed to a temperature of 800° C. or higher.

On the other hand, the austenitic heat-resistant steel is a material in which $M_{23}C_6$ type carbide has been precipitated, thereby enhancing strength at high temperature and wear resistance. The austenitic heat-resistant steel is poor in high temperature characteristics as compared with the Ni-based superalloy, but is inexpensive. For this reason, a valve using this is mainly used in engines that do not require high heat resistance.

Various proposals have been conventionally made for materials suitable for such an exhaust valve.

For example, Patent Document 1 discloses a heat-resistant alloy for exhaust valves, containing, by weight %, C: 0.01 to 0.2%, Si: 1% or less, Mn: 1% or less, Ni: 30 to 62%, Cr: 13 to 20%, W: 0.01 to 3.0%, Al: 0.7% or more and less than 1.6%, Ti: 1.5 to 3.0%, B: 0.001 to 0.01%, P: 0.02% or less, and S: 0.01% or less, with the balance being Fe and unavoidable impurities.

Moreover, Patent Document 2 discloses an Fe—Cr—Ni heat-resistant alloy containing, by weight %, C: 0.01 to 0.10%, Si: 2% or less, Mn: 2% or less, Cr: 14 to 18%, Nb+Ta: 0.5 to 1.5%, Ti: 2.0 to 3.0%, Al: 0.8 to 1.5%, Ni: 30 to 35%, B: 0.001 to 0.01%, Cu: 0.5% or less, P: 0.02% or less, S: 0.01% or less, O: 0.01% or less, and N: 0.01% or less, with the balance being Fe and unavoidable impurities, and the alloy having a given component balance.

Furthermore, Patent Document 3 discloses a method for producing an automobile engine valve, comprising subjecting an Fe-based heat-resistant steel having a composition of Fe—0.53% C—0.2% Si—9.2% Mn—3.9% Ni—21.5% Cr—0.43% N to solution heat treatment at from 1,100 to 1,180° C., forging a valve head part at from 700 to 1,000° C., and subjecting to aging treatment.

This Patent Document describes that when the Fe-based heat-resistant steel having a given composition is subjected to solution heat treatment, forging and aging treatment under given conditions, a valve face part can be made to have hardness of HV 400 or more.

By recent sudden rise in raw material cost, production cost of an exhaust valve is greatly influenced by the fluctuation in raw material cost. In particular, because an Ni-based superalloy has large Ni content, raw material cost and production cost of an exhaust valve made of an Ni-based superalloy greatly receive the influence of Ni price. For this reason, a material in which an amount of Ni is further reduced and fluctuation width of raw material cost is decreased is desired. However, in an Ni-based superalloy, Ni is a forming element of γ' phase that is a strengthening phase. Therefore, further reduction in the amount of Ni makes high strengthening utilizing γ' phase difficult.

On the other hand, a carbide precipitation type austenitic heat-resistant steel is difficult to receive the influence of Ni price, but has a problem that high temperature characteristics are poor as compared with a γ' phase precipitation type Ni-based superalloy. To solve this problem, a material obtained by highly strengthening SUH35 (for example, overseas standard LV21-43 steel (SUH35+1W, 2Nb)) is known. However, the LV21-43 steel still has the problems such that structure is difficult to control and hot workability is poor.

BACKGROUND ART DOCUMENT

Patent Document

Patent Document 1: JP-A-2004-277860
Patent Document 2: JP-A-9-279309
Patent Document 3: JP-A-2001-323323

SUMMARY OF THE INVENTION

Problems that the Invention is to Solve

An object to be attained by the present invention is to provide a heat-resistant steel for exhaust valves, having relatively small Ni content, high mechanical characteristics (for example, tensile strength, fatigue strength, wear resistance and hardness) at high temperature, and excellent oxidation resistance.

Means for Solving the Problems

To solve the above problem, a heat-resistant steel for exhaust valves according to the present invention having the following constitutions.

(1) The heat-resistant steel for exhaust valves comprises:
$0.45 \leq C < 0.60$ mass %,
$0.30 < N < 0.50$ mass %,
$19.0 \leq Cr < 23.0$ mass %,
$5.0 \leq Ni < 9.0$ mass %,
$8.5 \leq Mn < 10.0$ mass %,
$2.5 \leq Mo < 4.0$ mass %,
$0.01 \leq Si < 0.50$ mass %, and
$0.01 \leq Nb < 0.30$ mass %,
with the balance being Fe and unavoidable impurities.

(2) The heat-resistant steel for exhaust valves satisfies $0.02 \leq Nb/C < 0.70$.

(3) The heat-resistant steel for exhaust valves satisfies $4.5 \leq Mo/C < 8.9$ (wherein Nb/C represents a ratio of Nb content (mass %) to C content (mass %), and Mo/C represents a ratio of Mo content (mass %) to C content (mass %)).

Moreover, it is preferred that the heat-resistant steel for exhaust valves satisfies $5.2 \leq Mo/C \leq 8.0$.

Also, the heat-resistant steel for exhaust valves may further contain $0.0001 \leq (Al, Mg, Ca) < 0.01$ mass % (wherein (Al, Mg, Ca) represents the total amount of Al, Mg and Ca).

Furthermore, the heat-resistant steel for exhaust valves may further contain at least one selected from $0.0001 \leq B < 0.03$ mass % and $0.0001 \leq Zr < 0.1$ mass %.

Advantage of the Invention

In an austenitic heat-resistant steel, when solid solution strengthening elements such as N and Mo, and carbide forming elements such as Nb and Cr are optimized, thereby optimizing MX type carbide amount, $M_{23}C_6$ type carbide amount and solid solution strengthening amount, high temperature characteristics (wear resistance and impact resistance) are enhanced and a heat-resistant steel for exhaust valves having excellent hot workability is obtained.

Particularly, when Mo/C falls within a given range, wear resistance is improved by solid solution strengthening by solid solution strengthening elements, and additionally impact characteristics are improved by the reduction in carbide amount. Furthermore, when Nb/C falls within a given range, Nb type carbide (NbC) amount and size are optimized, and impact characteristics are improved. Furthermore, when the solid solution strengthening element is limited to Mo, phase stability is secured.

MODE FOR CARRYING OUT THE INVENTION

Figure 1:
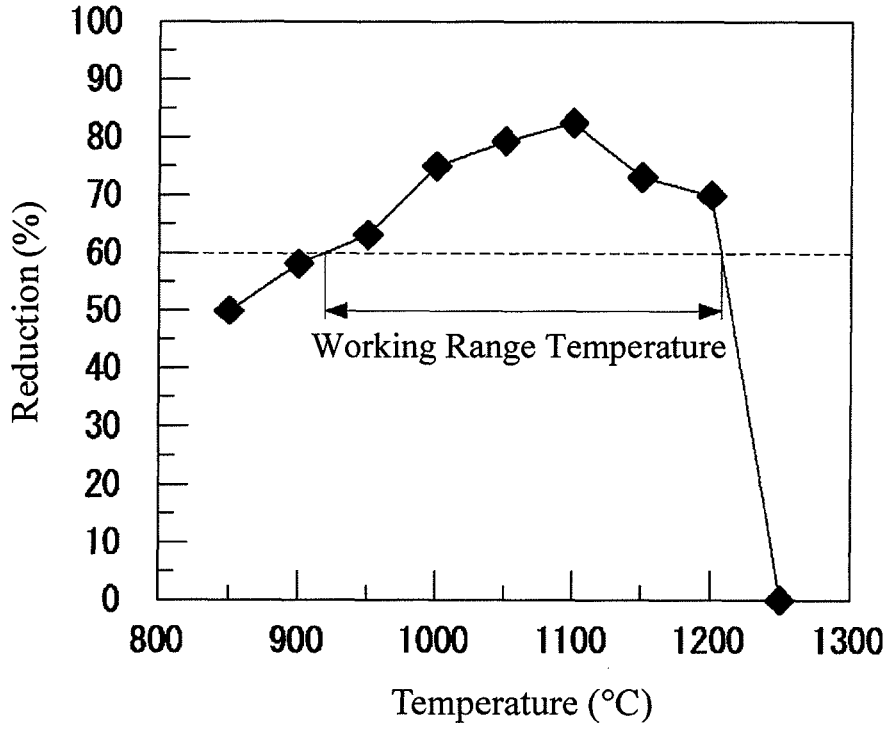
FIG. 1 is a view showing a measurement example of working range temperature.

One embodiment of the present invention is described in detail below.

[1. Heat-Resistant Steel for Exhaust Valves]

The heat-resistant steel for exhaust valves according to the present invention contains the following elements, with the balance being Fe and unavoidable impurities. Kinds of elements added, its component range and the reason for limitation thereof are as follows.

[1.1. Main Constituent Element]

(1) $0.45 \leq C < 0.60$ Mass %

C is an austenite stabilizing element, and suppresses the formation of sigma phase and Laves phase that are harmful phases. Moreover, C preferentially bonds to Nb to form MC type carbide. The MC type carbide suppresses grain coarsening during solution heat treatment and improves strength characteristics. Also, NbC is stable carbide, and the presence thereof in the structure suppresses grain coarsening, resulting in the improvement in hot workability. Moreover, the MC type carbide acts as a hard phase and improves wear resistance. Furthermore, C bonds to Cr to form $M_{23}C_6$ type carbide, thereby improving wear resistance and strength characteristics. To obtain such an effect, the C content is required to be 0.45 mass % or more. The C content is preferably more than 0.45 mass %, and more preferably more than 0.48 mass %.

On the other hand, where the C content becomes excessive, the carbide amount becomes excessive, thereby deteriorating workability and impact characteristics. Therefore, the C content is required to be less than 0.60 mass %. The C content is more preferably less than 0.57 mass %.

(2) $0.30 < N < 0.50$ Mass %

N is an austenite stabilizing element, and acts as a substitute element of austenite forming elements such as Ni and Mn. Moreover, N has small atomic radium, and therefore acts as an interstitial solid solution strengthening element and strengthens a matrix. Additionally, N multiply acts with a substitution type solid solution strengthening element such as Mo and W, and contributes to the improvement in strength. C and N are strong austenite forming elements and effectively act as a substitute element of expensive Ni to reduce costs. Furthermore, N further acts to form MX type carbonitride, in place of C site of MC type carbide. To obtain such an effect, the N content is required to be more than 0.30 mass %. The N content is more preferably more than 0.33 mass %.

On the other hand, in the case where the N content becomes excessive, it is difficult to solubilize N in a matrix. For this reason, the N content is required to be less than 0.50 mass %. The N content is more preferably less than 0.47 mass %.

(3) $19.0 \leq Cr < 23.0$ Mass %

Cr has an action to form a protective oxide coating film of $Cr_2O_3$ in a use temperature region of an exhaust valve. For this reason, Cr is an essential element to improve corrosion resistance and oxidation resistance. Moreover, Cr bonds to C to form $Cr_{23}C_6$ carbide, thereby contributing to the improvement in strength characteristics. To obtain such an effect, the Cr content is required to be 19.0 mass % or more.

On the other hand, Cr is a ferrite stabilizing element. Therefore, excessive N content destabilizes austenite. Furthermore, excessive addition of Cr promotes formation of sigma phase and Laves phase that are embrittlement phases, resulting in deterioration in hot workability, strength characteristics and impact characteristics. Therefore, the Cr content is required to be less than 23.0 mass %.

(4) $5.0 \leq Ni < 9.0$ Mass %

Ni is added as an austenite stabilizing element. To stabilize austenite, the Ni content is required to be 5.0 mass % or more.

On the other hand, excessive Ni content leads to high costs. Therefore, the Ni content is required to be less than 9.0 mass %.

(5) $8.5 \leq Mn < 10.0$ Mass %

Mn is added as an austenite stabilizing element. Mn not only acts as a substitute element of expensive Ni, but has the effect of increasing solubility of N. To obtain such an effect, the Mn content is required to be 8.5 mass % or more.

On the other hand, excessive Mn content leads to high costs. Therefore, the Mn content is required to be less than 10.0 mass %.

(6) $2.5 \leq Mo < 4.0$ Mass %

Mo acts as a solid solution strengthening element of a matrix γ phase, and is an element effective to improve high temperature strength. To obtain such an effect, the Mo content is required to be 2.5 mass % or more.

The Mo content is preferably more than 3.0 mass %.

On the other hand, excessive Mo content increases deformation resistance. Furthermore, excessive Mo content promotes the formation of sigma phase and Laves phase that are embrittlement phases, and deteriorates hot workability and impact characteristics. For this reason, the Mo content is required to be less than 4.0 mass %. The Mo content is preferably less than 3.5 mass %.

Incidentally, as the solid solution strengthening element, there is a method of W addition other than Mo addition. However, the present invention limits to Mo addition. Solid solution strengthening amount by solid solution strengthening elements such as Mo or W greatly depends on atomic weight. Mo has small atomic weight as compared with W, and atomic number per unit mass % is large. Therefore, solid solution strengthening amount is large. For this reason, in the case of obtaining the equivalent solid solution strengthening amount by W addition, precipitation of Laves phase becomes dominant, and the effect equivalent to Mo is not obtained. For this reason, the present invention limits to Mo addition to maximally obtain the effect of solid solution strengthening.

(7) 0.01≤Si<0.50 Mass %

Si is an effective element as a deoxidizing agent during melting and to impart oxidation resistance in high temperature range. Furthermore, Si has the effect of improving strength as a solid solution strengthening element. To obtain such an effect, the Si content is required to be more than 0.01 mass %. The Si content is preferably 0.03 mass % or more.

On the other hand, excessive Si content leads to deterioration in workability and deterioration in impact characteristics by the compound having low melting point. For this reason, the Si content is required to be less than 0.50 mass %. The Si content is preferably less than 0.30 mass %.

(8) 0.01≤Nb<0.30 Mass %

Nb bonds to C and N, thereby precipitating MX type carbonitride (including MC type carbide, thereinafter the same). The MX type carbonitride having an appropriate size and an appropriate amount suppresses grain coarsening after solution heat treatment, and is effective to improve high temperature strength characteristics and hot workability. To obtain such an effect, the Nb content is required to be 0.01 mass % or more.

On the other hand, excessive addition of Nb promotes formation of ferrite, and forms a large amount of coarse carbonitride. A part of the coarse carbonitride remains even after the solution heat treatment, and this leads to deterioration in hot workability and impact characteristics. For this reason, the Nb content is required to be less than 0.30 mass %. The Nb content is preferably less than 0.25 mass %.

Incidentally, elements for forming the MX type compound include Ti and V, other than Nb, but the present invention limits to Nb. The reason for this is as follows.

Ti has strong bonding force to C and N and crystallizes a large amount of relatively coarse primary crystal MX carbonitride (primary carbide). The primary carbide of Ti is carbide having very high stability, and the primary carbide does not dissolve even by solution heat treatment. Therefore, the coarse carbonitride greatly affects deterioration in impact characteristics. Furthermore, Ti has strong bonding force to O, and therefore forms Ti oxide, thereby remarkably deteriorating oxidation resistance of a material.

Moreover, V is effective to improve strength characteristics. However, V has strong bonding force to O, and therefore forms V oxide, thereby remarkably deteriorating oxidation resistance of a material.

For the above reason, the MX type carbonitride forming element is limited to Nb from the balance of strength characteristics and oxidation resistance.

[1.2. Sub-Constituent Element]

The heat-resistant steel for exhaust valves according to the present invention may further contain at least any one of the following elements, in addition to the elements described above.

(1) 0.0001≤(Al, Mg, Ca)<0.01 Mass %

Al, Mg and Ca each can be added as a deoxidizing and desulfurizing agent when melting an alloy. Al, Mg and/or Ca contribute to the improvement in hot workability of an alloy. To obtain such an effect, the total content of Al, Mg and Ca is preferably 0.0001 mass % or more.

On the other hand, excessive content of Al, Mg and/or Ca rather tends to deteriorate workability. For this reason, the total content of Mg and Ca is preferably less than 0.01 mass %.

(2) 0.0001≤B<0.03 Mass %

(3) 0.0001≤Zr<0.1 Mass %

Both B and Zr are segregated in crystal grain boundary and strengthen the boundary. To obtain such an effect, the contents of B and Zr are preferably 0.0001 mass % or more.

On the other hand, excessive contents of B and Zr lead to the deterioration in hot workability. For this reason, the B content is preferably less than 0.03 mass %. Furthermore, the Zr content is preferably less than 0.1 mass %.

Any one of B and Zr may be added, and both B and Zr may be added.

[1.3. Component Balance]

The heat-resistant steel for exhaust valves according to the present invention is characterized in that component elements fall within the above ranges and additionally, the following conditions are satisfied.

(1) 0.02≤Nb/C<0.70

MX type carbonitride having an appropriate size and appropriate amount has a role of preventing grain coarsening (improvement in hot workability) by pinning effect. Furthermore, fine MX carbonitride can suppress the deterioration in impact characteristics. To obtain such an effect, a ratio of Nb content (mass %) to C content (mass %) (=Nb/C) is required to be 0.02 or more.

On the other hand, in the case where Nb becomes relatively excessive to C, Nb dominantly bonds to C and a large amount of coarse primary crystal MX carbonitride is crystallized. The coarse primary crystal MX carbonitride does not completely disappear even after solution heat treatment, leading to the deterioration in impact characteristics. For this reason, Nb/C is required to be less than 0.70.

(2) 4.5≤Mo/C<8.9

In the case where a ratio of Mo content (mass %) to C content (mass %) (=Mo/C) is too small, the amount of Mo solid-solubilized in a matrix is decreased, and high temperature strength characteristics represented by high temperature hardness is deteriorated. For this reason, the Mo/C is required to be 4.5 or more. The Mo/C ratio is preferably 5.2 or more.

On the other hand, Cr site of $M_{23}C_6$ type carbide is substituted with Mo in a certain proportion. However, in the case where the Mo/C ratio is too large, stability of austenite phase is deteriorated or Laves phase and a phase that are embrittlement phases are precipitated, leading to the deterioration in impact characteristics or the deterioration in workability. For this reason, the Mo/C ratio is required to be less than 8.9. The Mo/C ratio is preferably 8.0 or less.

[2. Method for Producing Heat-Resistant Steel for Exhaust Valves]

A method for producing the heat-resistant steel for exhaust valves according to the present invention comprises a melting and casting step, a homogenizing heat treatment step, a forging step, a solution heat treatment step and an aging step.

[2.1. Melting and Casting Step]

The melting and casting step is a step for melting and casting raw materials added so as to have a given composition. A method for melting raw materials and a method for casting molten metal are not particularly limited, and various methods can be used. Melting conditions can be any conditions so long as components are homogeneous and casting-capable molten metal is obtained.

[2.2. Homogenizing Heat Treatment Step]

The homogenizing heat treatment step is a step of subjecting an ingot obtained by the melting and casting step to homogenizing heat treatment step. The homogenizing heat treatment is conducted to homogenize components of an ingot.

The homogenizing heat treatment conditions select optimum conditions depending on components. In general, the heat treatment temperature is from 1,100 to 1,250° C. Moreover, the heat treatment time is from 5 to 25 hours.

[2.3. Forging Step]

The forging step is a step of plastic-deforming the ingot after the homogenizing heat treatment into a given shape. The forging method and forging conditions are not particularly limited, and can be any forging method and forging conditions so long as the desired shape can be efficiently produced.

[2.4. Solution Heat Treatment Step]

The solution heat treatment step is a step of subjecting the material obtained by the forging step to solution heat treatment. The solution heat treatment step is conducted to cause coarse primary crystal MX carbonitride to disappear.

The solution heat treatment conditions select optimum conditions depending on components. In general, the residual amount of primary carbide is decreased and the amount of fine carbide in grains precipitated during aging treatment is increased, as the solution heat treatment temperature is increased. Therefore, high solution heat treatment temperature is effective to improve fatigue properties. However, in the case where the solution heat treatment is conducted at a temperature higher than 1,200° C., the precipitation of grain boundary reaction carbide is accelerated in the subsequent aging treatment, leading to the deterioration in characteristics. For this reason, the solution heat treatment conditions are preferably 1,000 to 1,200° C.×20 minutes or more+water cooling or oil cooling treatment.

[2.5. Aging Step]

The aging step is a step of subjecting the material after the solution heat treatment to aging treatment. The aging step is conducted to precipitate $M_{23}C_6$ type carbide.

The aging treatment conditions select optimum conditions depending on components. Although varying depending on components, the aging treatment conditions are preferably 700 to 850° C.×2 hours or more+air cooling treatment.

[3. Action of Heat-Resistant Steel for Exhaust Valves]

In an austenitic heat-resistant steel, when solid solution strengthening elements such as N and Mo, and carbide forming elements such as Nb and Cr are optimized, thereby optimizing MX type carbide amount, $M_{23}C_6$ type carbide amount and solid solution strengthening amount, high temperature characteristics (wear resistance and impact resistance) are enhanced and a heat-resistant steel for exhaust valves having excellent in hot workability is obtained.

In particular, in the case where Mo/C falls within a given range, wear resistance is improved by solid solution strengthening due to solid solution strengthening elements, and impact characteristics are improved by the reduction in carbide amount. Furthermore, when Nb/C falls within a given range, Nb type carbide (NbC) amount and a size are optimized, and impact characteristics are enhanced. Furthermore, in the case where the solid solution strengthening element is limited to Mo, phase stability is secured.

EXAMPLES

Examples 1 to 34 and Comparative Examples 1 to 14

[1. Preparation of Sample]

Alloys having compositions shown in Tables 1 and 2 were melted in a high frequency induction furnace, and 50 kg of ingot was obtained. The molten ingot was subjected to homogenizing heat treatment at 1,180° C. for 16 hours, and then subjected to forging process to obtain a bar material having a diameter of 18 mm. The forged bar material was subjected to solution heat treatment (ST) of 1,050° C.×30 minutes–oil cooling. Furthermore, the material after ST was subjected to aging treatment (AG) of 750° C.×4 hours–air cooling.

Incidentally, in Comparative Example 2, "Mo/C" represents "W/C". This may be attributed to the reason that regarding solid-solution strengthening, W achieves the effect similar to Mo.

Moreover, in Comparative Examples 4 and 5, "Nb/C" represents "V/C" and "Ti/C", respectively. This may be attributed to the reason that regarding the formation of carbonitride, V and Ti achieve the effect similar to Nb.

TABLE 1

| | Composition (mass %) | | | | | | | | | | |
|---|---|---|---|---|---|---|---|---|---|---|---|
| | C | Si | Mn | Cr | Ni | Mo | Nb | N | Other | Mo/C | Nb/C |
| Example 1 | 0.53 | 0.11 | 9.1 | 20.8 | 6.1 | 3.3 | 0.12 | 0.42 | | 6.2 | 0.23 |
| Example 2 | 0.46 | 0.15 | 8.9 | 21.1 | 5.9 | 3.2 | 0.09 | 0.43 | | 7.0 | 0.20 |
| Example 3 | 0.50 | 0.08 | 9.2 | 21.4 | 6.2 | 3.4 | 0.11 | 0.40 | | 6.8 | 0.22 |
| Example 4 | 0.55 | 0.12 | 9.2 | 20.7 | 5.8 | 3.6 | 0.10 | 0.39 | | 6.5 | 0.18 |
| Example 5 | 0.58 | 0.09 | 9.1 | 21.1 | 5.8 | 3.4 | 0.11 | 0.41 | | 5.9 | 0.19 |
| Example 6 | 0.51 | 0.13 | 9.3 | 19.8 | 6.0 | 3.1 | 0.05 | 0.32 | | 6.1 | 0.10 |
| Example 7 | 0.53 | 0.11 | 8.9 | 21.7 | 6.2 | 3.2 | 0.16 | 0.39 | | 6.0 | 0.30 |
| Example 8 | 0.52 | 0.11 | 9.0 | 21.4 | 6.1 | 3.4 | 0.22 | 0.44 | | 6.5 | 0.42 |
| Example 9 | 0.50 | 0.10 | 9.1 | 21.5 | 6.3 | 2.9 | 0.14 | 0.48 | | 5.8 | 0.28 |
| Example 10 | 0.49 | 0.02 | 9.3 | 20.8 | 5.8 | 3.0 | 0.17 | 0.42 | | 6.1 | 0.35 |
| Example 11 | 0.54 | 0.06 | 8.8 | 21.0 | 6.0 | 3.3 | 0.13 | 0.40 | | 6.1 | 0.24 |
| Example 12 | 0.50 | 0.28 | 9.0 | 20.9 | 6.0 | 3.4 | 0.13 | 0.45 | | 6.8 | 0.26 |
| Example 13 | 0.52 | 0.38 | 9.0 | 21.3 | 5.9 | 2.8 | 0.08 | 0.38 | | 5.4 | 0.15 |
| Example 14 | 0.50 | 0.09 | 8.7 | 21.5 | 5.9 | 3.0 | 0.13 | 0.42 | | 6.0 | 0.26 |
| Example 15 | 0.53 | 0.11 | 9.8 | 21.8 | 5.8 | 3.3 | 0.08 | 0.43 | | 6.2 | 0.15 |
| Example 16 | 0.51 | 0.12 | 8.8 | 20.1 | 5.6 | 3.1 | 0.13 | 0.45 | | 6.1 | 0.25 |
| Example 17 | 0.49 | 0.11 | 9.1 | 22.6 | 6.0 | 3.3 | 0.13 | 0.41 | | 6.7 | 0.27 |
| Example 18 | 0.51 | 0.11 | 9.2 | 20.9 | 5.5 | 3.1 | 0.11 | 0.45 | | 6.1 | 0.22 |
| Example 19 | 0.53 | 0.17 | 9.0 | 21.6 | 8.7 | 3.2 | 0.14 | 0.41 | | 6.0 | 0.26 |
| Example 20 | 0.56 | 0.10 | 8.9 | 21.4 | 6.1 | 2.7 | 0.13 | 0.38 | | 4.8 | 0.23 |
| Example 21 | 0.51 | 0.10 | 9.0 | 20.9 | 6.0 | 3.0 | 0.13 | 0.42 | | 5.9 | 0.25 |

TABLE 1-continued

| | Composition (mass %) | | | | | | | | | | |
|---|---|---|---|---|---|---|---|---|---|---|---|
| | C | Si | Mn | Cr | Ni | Mo | Nb | N | Other | Mo/C | Nb/C |
| Example 22 | 0.52 | 0.13 | 9.1 | 22.2 | 5.9 | 3.5 | 0.12 | 0.43 | | 6.7 | 0.23 |
| Example 23 | 0.53 | 0.09 | 8.9 | 20.9 | 6.5 | 3.9 | 0.14 | 0.41 | | 7.4 | 0.26 |
| Example 24 | 0.53 | 0.12 | 9.0 | 21.0 | 5.9 | 3.2 | 0.04 | 0.40 | | 6.0 | 0.08 |
| Example 25 | 0.48 | 0.11 | 9.0 | 21.0 | 5.6 | 3.3 | 0.22 | 0.42 | | 6.9 | 0.46 |

TABLE 2

| | Composition (mass %) | | | | | | | | | | |
|---|---|---|---|---|---|---|---|---|---|---|---|
| | C | Si | Mn | Cr | Ni | Mo | Nb | N | Other | Mo/C | Nb/C |
| Example 26 | 0.46 | 0.11 | 8.9 | 21.5 | 5.9 | 3.7 | 0.28 | 0.43 | | 8.0 | 0.61 |
| Example 27 | 0.53 | 0.12 | 9.1 | 21.1 | 6.0 | 3.4 | 0.12 | 0.41 | Ca: 0.0015 | 6.4 | 0.23 |
| Example 28 | 0.50 | 0.12 | 8.8 | 20.9 | 6.3 | 3.1 | 0.14 | 0.43 | Al: 0.0020 | 6.2 | 0.28 |
| Example 29 | 0.52 | 0.14 | 9.1 | 21.4 | 6.3 | 3.3 | 0.16 | 0.40 | Mg: 0.0021 | 6.3 | 0.31 |
| Example 30 | 0.53 | 0.15 | 9.2 | 21.5 | 6.1 | 3.4 | 0.17 | 0.42 | Zr: 0.0018 | 6.4 | 0.32 |
| Example 31 | 0.52 | 0.10 | 9.0 | 21.4 | 6.0 | 3.2 | 0.13 | 0.39 | B: 0.0055 | 6.2 | 0.25 |
| Example 32 | 0.52 | 0.09 | 8.8 | 21.2 | 6.1 | 3.2 | 0.13 | 0.41 | Ca: 0.0011<br>Al: 0.0016 | 6.2 | 0.25 |
| Example 33 | 0.51 | 0.11 | 9.2 | 20.9 | 5.9 | 3.3 | 0.12 | 0.40 | Mg: 0.0023<br>Al: 0.0016 | 6.5 | 0.24 |
| Example 34 | 0.52 | 0.10 | 8.6 | 21.0 | 5.8 | 3.2 | 0.16 | 0.39 | Al: 0.0015<br>B: 0.0050 | 6.2 | 0.31 |
| Comparative Example 1 | 0.49 | 0.09 | 8.9 | 21.2 | 3.9 | — | — | 0.40 | | 0.0 | 0.00 |
| Comparative Example 2 | 0.50 | 0.08 | 9.0 | 21.0 | 4.0 | — | 2.03 | 0.45 | W: 1.0 | 2.0 | 4.06 |
| Comparative Example 3 | 0.65 | 0.71 | 9.2 | 20.9 | 6.1 | 4.1 | 0.10 | 0.45 | | 6.3 | 0.15 |
| Comparative Example 4 | 0.64 | 0.34 | 9.1 | 20.7 | 6.3 | 3.8 | — | 0.51 | V: 0.82 | 5.9 | 1.28 |
| Comparative Example 5 | 0.63 | 0.39 | 9.0 | 21.2 | 6.1 | 3.7 | — | 0.42 | Ti: 0.78 | 5.9 | 1.24 |
| Comparative Example 6 | 0.63 | 0.32 | 11.8 | 21.6 | 7.3 | 3.0 | 1.40 | 0.32 | | 4.8 | 1.24 |
| Comparative Example 7 | 0.62 | 0.22 | 8.7 | 20.1 | 10.2 | 2.9 | 0.73 | 0.31 | | 4.7 | 1.26 |
| Comparative Example 8 | 0.61 | 0.71 | 9.2 | 21.1 | 5.9 | 3.2 | 0.69 | 0.40 | | 5.2 | 1.13 |
| Comparative Example 9 | 0.58 | 0.23 | 8.7 | 24.3 | 6.0 | 2.0 | 0.87 | 0.40 | | 3.4 | 1.50 |
| Comparative Example 10 | 0.55 | 0.32 | 8.8 | 18.7 | 6.2 | 1.0 | 2.00 | 0.42 | | 1.8 | 3.64 |
| Comparative Example 11 | 0.60 | 0.25 | 8.9 | 21.7 | 6.4 | 1.0 | 2.00 | 0.26 | | 1.7 | 3.33 |
| Comparative Example 12 | 0.56 | 0.17 | 9.0 | 20.8 | 6.3 | 2.3 | 1.40 | 0.40 | | 4.1 | 2.50 |
| Comparative Example 13 | 0.61 | 0.36 | 9.1 | 20.8 | 6.2 | 3.9 | 0.25 | 0.40 | P: 0.25 | 6.4 | 0.41 |
| Comparative Example 14 | 0.58 | 0.35 | 8.9 | 22.4 | 4.7 | 4.3 | 0.81 | 0.30 | Cu: 0.4 | 7.4 | 1.40 |

[2. Test Method]

[2.1. High Temperature Hardness]

Hardness at 800° C. of the material after the aging treatment was measured under measurement load of 5 kg using high temperature Vickers hardness tester. A material having high temperature hardness of 190 (HV) or more was judged as "◎ (Excellent)", a material having high temperature hardness of 150 (HV) or more and less than 190 (HV) was judged as "○ (Good)", and a material having high temperature hardness less than 150 (HV) was judged as "Δ (Fair)".

[2.2. Charpy Impact Test]

A test piece having 10 mm square, a length of 55 mm and 2 mm U notch (according to JIS Z2202) was cut off from each material after the aging treatment, and subjected to an impact test of 800° C. Incidentally, this test was carried out in the test content according to JIS B7722. A material having an impact value of 90 (J/cm$^2$) or more was judged as "◎ (Excellent)", a material having an impact value of 70 (J/cm$^2$) or more and less than 90 (J/cm$^2$) was judged as "○ (Good)", and a material having an impact value less than 70 (J/cm$^2$) was judged as "Δ (Fair)".

[2.3. High Temperature High Speed Tensile Test]

A test piece having a diameter of a parallel part of 4.5 mm was prepared from the material having been subjected to forging process, and workability thereof was evaluated with a high temperature high speed tensile tester. The test conditions were temperature rising time up to test temperature: 100 s, holding time at test temperature: 60 s, and crosshead speed: 50.8 mm/s. After breaking the test piece, a reduction of area at break was measured. A temperature at which the reduction of area at break is 60% or more (working range temperature) was obtained in each material.

One example of the working range temperature is shown in FIG. 1. A material having a working temperature range of 270° C. or higher was judged as "◎ (Excellent)", a material having a working temperature range of 230° C. or higher and lower than 270° C. was judged as "○ (Good)", and a material having a working temperature range lower than 230° C. was judged as "Δ (Fair)".

[2.4. Continuous Oxidation Test]

A test piece having 25 mm×13 mm×2 mm was cut off from the material after the aging treatment, and subjected to a continuous oxidation test of 850° C.×400 hours. A material having oxidation weight gain of 1.6 (mg/cm$^2$) or less judged as "◎ (Excellent)", a material having oxidation weight gain of more than 1.6 (mg/cm$^2$) and 2.5 (mg/cm$^2$) or less was judged as "○ (Good)", and a material having oxidation weight gain more than 2.5 (mg/cm$^2$) was judged as "Δ (Fair)".

[3. Result]

[3.1. High Temperature Hardness, Impact Value and Working Range Temperature]

Figure 2:
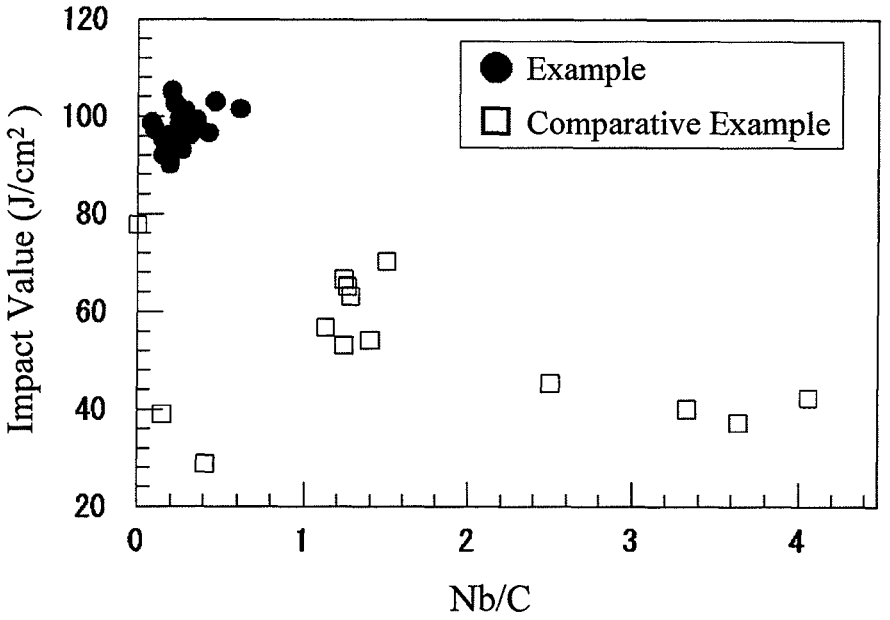
FIG. 2 is a view showing the relationship between Nb/C and an impact value.
Figure 3:
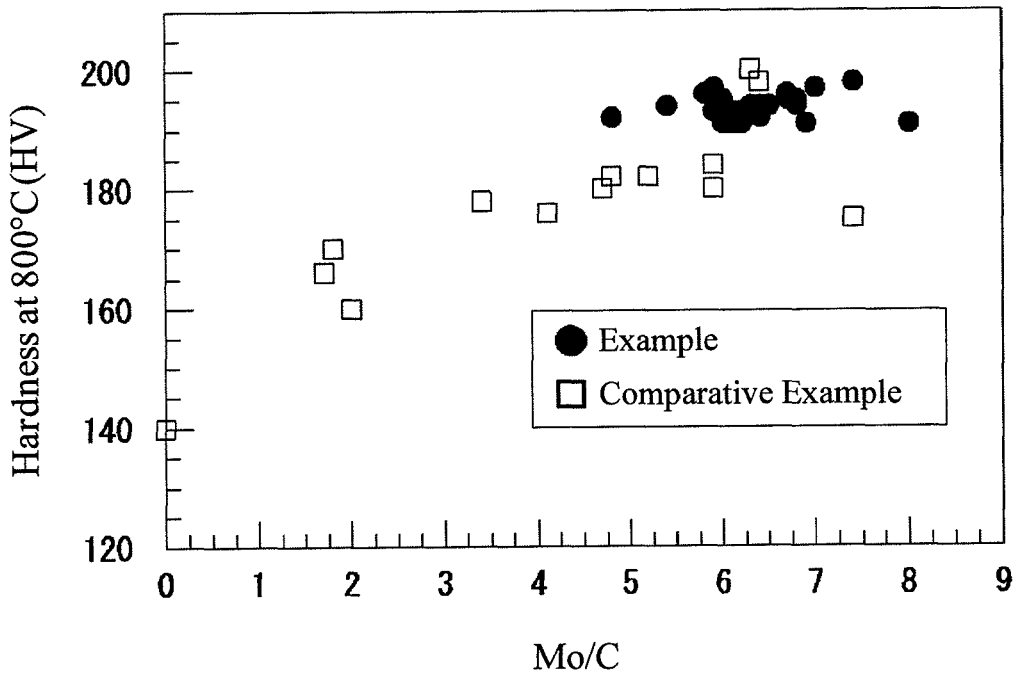
FIG. 3 is a view showing the relationship between Mo/C and 800° C. hardness.

The high temperature hardness, impact value and working range temperature are shown in Tables 3 and 4. The relationship between Nb/C and the impact value is shown in FIG. 2. Furthermore, the relationship between Mo/C and 800° C. hardness is shown in FIG. 3. The following facts are understood from Table 3, Table 4, FIG. 2 and FIG. 3.

(1) Comparative Example 1 having the composition corresponding to SUH35 is that the working range temperature is wide, but both the impact value and the high temperature hardness are low. Moreover, Comparative Example 2 having the composition corresponding to LV21-43 steel is that the impact value and the high temperature hardness are low, and the working range temperature is narrow.

(2) Comparative Example 3 is that the high temperature hardness is high, but the impact value is low and the working range temperature is narrow. Moreover, in all the Comparative Examples 4 to 12, the high temperature hardness and the impact value are low, and the working range temperature is narrow. This may be attributed to the reason that the components and the component balance are not proper.

(3) Comparative Example 13 in which P was added is that the impact value is particularly low. This may be attributed to the reason that coarsening of the precipitated carbide after the aging treatment occurs by the addition of P.

(4) Comparative Example 14 in which Cu was added is that the working range temperature is particularly low. This may be attributed to the reason that a melting point of the material is decreased by the addition of Cu.

(5) In all the Examples 1 to 34, the high temperature hardness and the impact value are high, and the working temperature range is wide.

(6) Particularly, in exhaust valves, a sheet material is provided on a contact surface to a valve on the mechanism of an engine in order to seal the inside of a cylinder and holding the state. In adhering between the sheet material and the valve, high stress is applied to an underhead part of the valve. To suppress premature failure by the stress applied to the underhead part, the impact value is an important index. Because all the Examples 1 to 34 have high impact value, the premature failure is suppressed, and long-life can be achieved.

(7) As shown in FIG. 2, when Nb/C is limited to the range of from 0.02 to 0.70, high impact value of 90 J/cm$^2$ or more is obtained.

(8) As shown in FIG. 3, when Mo/C is limited to the range of from 4.5 to 8.9, the high temperature hardness of about 190 (HV) or more is obtained. Furthermore, when the Mo/C is limited to the range of from 5.2 to 8.0, the high temperature hardness is further improved (about 1 to 5 (HV)).

TABLE 3

| | Impact value | | Hardness | | Working range temperature | |
|---|---|---|---|---|---|---|
| | (J/cm$^2$) | Evaluation | (HV) | Evaluation | (° C.) | Evaluation |
| Example 1 | 96.0 | ◎ | 191 | ◎ | 300 | ◎ |
| Example 2 | 105.3 | ◎ | 197 | ◎ | 320 | ◎ |
| Example 3 | 102.7 | ◎ | 195 | ◎ | 310 | ◎ |
| Example 4 | 96.2 | ◎ | 194 | ◎ | 300 | ◎ |
| Example 5 | 90.2 | ◎ | 197 | ◎ | 280 | ◎ |
| Example 6 | 97.3 | ◎ | 192 | ◎ | 300 | ◎ |
| Example 7 | 96.4 | ◎ | 191 | ◎ | 310 | ◎ |
| Example 8 | 96.7 | ◎ | 194 | ◎ | 310 | ◎ |
| Example 9 | 97.0 | ◎ | 196 | ◎ | 300 | ◎ |
| Example 10 | 99.3 | ◎ | 191 | ◎ | 310 | ◎ |
| Example 11 | 94.5 | ◎ | 192 | ◎ | 310 | ◎ |
| Example 12 | 99.3 | ◎ | 194 | ◎ | 270 | ◎ |
| Example 13 | 92.1 | ◎ | 194 | ◎ | 270 | ◎ |
| Example 14 | 95.3 | ◎ | 195 | ◎ | 310 | ◎ |
| Example 15 | 95.2 | ◎ | 193 | ◎ | 300 | ◎ |
| Example 16 | 98.7 | ◎ | 193 | ◎ | 300 | ◎ |
| Example 17 | 101.3 | ◎ | 195 | ◎ | 300 | ◎ |
| Example 18 | 96.4 | ◎ | 193 | ◎ | 300 | ◎ |
| Example 19 | 95.2 | ◎ | 193 | ◎ | 290 | ◎ |
| Example 20 | 93.2 | ◎ | 192 | ◎ | 310 | ◎ |
| Example 21 | 99.8 | ◎ | 193 | ◎ | 300 | ◎ |
| Example 22 | 95.8 | ◎ | 196 | ◎ | 300 | ◎ |
| Example 23 | 93.2 | ◎ | 198 | ◎ | 300 | ◎ |
| Example 24 | 98.8 | ◎ | 194 | ◎ | 320 | ◎ |
| Example 25 | 103.1 | ◎ | 191 | ◎ | 280 | ◎ |

TABLE 4

| | Impact value | | Hardness | | Working range temperature | |
|---|---|---|---|---|---|---|
| | (J/cm$^2$) | Evaluation | (HV) | Evaluation | (° C.) | Evaluation |
| Example 26 | 101.6 | ◎ | 191 | ◎ | 280 | ◎ |
| Example 27 | 95.8 | ◎ | 194 | ◎ | 340 | ◎ |
| Example 28 | 101.3 | ◎ | 193 | ◎ | 330 | ◎ |
| Example 29 | 96.3 | ◎ | 194 | ◎ | 330 | ◎ |
| Example 30 | 97.3 | ◎ | 192 | ◎ | 330 | ◎ |
| Example 31 | 98.3 | ◎ | 193 | ◎ | 330 | ◎ |
| Example 32 | 96.2 | ◎ | 193 | ◎ | 340 | ◎ |
| Example 33 | 95.8 | ◎ | 193 | ◎ | 330 | ◎ |
| Example 34 | 96.4 | ◎ | 194 | ◎ | 340 | ◎ |
| Comparative Example 1 | 77.7 | ○ | 140 | Δ | 340 | ◎ |
| Comparative Example 2 | 42.3 | Δ | 160 | ○ | 250 | ○ |
| Comparative Example 3 | 39.0 | Δ | 200 | ◎ | 220 | Δ |
| Comparative Example 4 | 63.2 | Δ | 180 | ○ | 220 | Δ |
| Comparative Example 5 | 53.1 | Δ | 184 | ○ | 190 | Δ |
| Comparative Example 6 | 66.6 | Δ | 182 | ○ | 210 | Δ |
| Comparative Example 7 | 65.2 | Δ | 180 | ○ | 210 | Δ |
| Comparative Example 8 | 56.8 | Δ | 182 | ○ | 190 | Δ |
| Comparative Example 9 | 70.3 | ○ | 178 | ○ | 200 | Δ |
| Comparative Example 10 | 37.2 | Δ | 170 | ○ | 190 | Δ |
| Comparative Example 11 | 40.1 | Δ | 166 | ○ | 190 | Δ |

TABLE 4-continued

| | Impact value | | Hardness | | Working range temperature | |
|---|---|---|---|---|---|---|
| | (J/cm$^2$) | Evaluation | (HV) | Evaluation | (° C.) | Evaluation |
| Comparative Example 12 | 45.3 | Δ | 176 | ○ | 210 | Δ |
| Comparative Example 13 | 28.8 | Δ | 198 | ◎ | 100 | Δ |
| Comparative Example 14 | 54.2 | Δ | 175 | ○ | 180 | Δ |

[3.2. Continuous Oxidation Test]

A part of the results of the continuous oxidation test is shown in Table 5. The following facts are understood from Table 5.

(1) Comparative Examples 4 and 5 in which V and Ti that are MX type carbonitride forming element similar to Nb and the same result is considered to be obtained were added are that oxidation weight gain is large as compared with the Examples and other Comparative Examples. Those elements have large bonding force to O as compared with Nb, and therefore, the formation of an oxide easily occurs. As a result, it is considered that oxidation resistance was deteriorated. In other words, Ti and V are impossible to be used as a substitute element of Nb.

(2) All the Examples 1 to 34 showed good oxidation resistance.

TABLE 5

| | Oxidation weight gain | |
|---|---|---|
| | (mg/cm$^2$) | Evaluation |
| Example 1 | 1.35 | ◎ |
| Example 10 | 1.46 | ◎ |
| Example 13 | 1.20 | ◎ |
| Example 16 | 1.51 | ◎ |
| Example 17 | 1.22 | ◎ |
| Example 23 | 1.33 | ◎ |
| Comparative Example 1 | 3.44 | Δ |
| Comparative Example 4 | 4.23 | Δ |
| Comparative Example 5 | 3.85 | Δ |
| Comparative Example 10 | 2.24 | ○ |

Although the present invention has been described in detail and by reference to the specific embodiments, it is apparent to one skilled in the art that various modifications or changes can be made without departing the spirit and scope of the present invention.

Incidentally, this application is based on Japanese Patent Application No. 2011-182987 filed Aug. 24, 2011 and Japanese Patent Application No. 2012-112238 filed May 16, 2012, the disclosures of which are incorporated herein by reference in their entities.

INDUSTRIAL APPLICABILITY

The heat-resistant steel for exhaust valves according to the present invention can be used in exhaust valves of various engines.

The invention claimed is:

1. A heat-resistant steel for exhaust valves, consisting of:
0.45≤C<0.60 mass %,
0.30<N<0.50 mass %,
19.0≤Cr<23.0 mass %,
5.0≤Ni<9.0 mass %,
8.5≤Mn<10.0 mass %,
2.5≤Mo<4.0 mass %,
0.01≤Si<0.50 mass %, and
0.01≤Nb<0.30 mass %,
with the balance being Fe and unavoidable impurities;
the heat-resistant steel for exhaust valves satisfying 0.02≤Nb/C≤0.61 and 4.5≤Mo/C≤8.0.

2. The heat-resistant steel for exhaust valves according to claim 1, which satisfies 5.2≤Mo/C≤8.0.

3. A heat-resistant steel for exhaust valves, consisting of:
0.45≤C<0.60 mass %,
0.30<N<0.50 mass %,
19.0≤Cr<23.0 mass %,
5.0≤Ni<9.0 mass %,
8.5≤Mn<10.0 mass %,
2.5≤Mo<4.0 mass %,
0.01≤Si<0.50 mass %,
0.01≤Nb<0.30 mass %, and
0.0001≤(Al, Mg, Ca)<0.01 mass %
with the balance being Fe and unavoidable impurities;
the heat-resistant steel for exhaust valves satisfying 0.02≤Nb/C≤0.61 and 4.5≤Mo/C≤8.0.

4. A heat-resistant steel for exhaust valves, consisting of:
0.45≤C<0.60 mass %,
0.30<N<0.50 mass %,
19.0≤Cr<23.0 mass %,
5.0≤Ni<9.0 mass %,
8.5≤Mn<10.0 mass %,
2.5≤Mo<4.0 mass %,
0.01≤Si<0.50 mass %,
0.01≤Nb<0.30 mass %, and
at least one selected from 0.0001≤B<0.03 mass % and 0.0001≤Zr<0.1 mass %,
with the balance being Fe and unavoidable impurities;
the heat-resistant steel for exhaust valves satisfying 0.02≤Nb/C≤0.61 and 4.51≤Mo/C≤8.0.

5. The heat-resistant steel for exhaust valves according to claim 3, which satisfies 5.2≤Mo/C≤8.0.

6. The heat-resistant steel for exhaust valves according to claim 4, which satisfies 5.2≤Mo/C≤8.0.

7. A heat-resistant steel for exhaust valves, consisting of:
0.45≤C<0.60 mass %,
0.30<N<0.50 mass %,
19.0≤Cr<23.0 mass %,
5.0≤Ni<9.0 mass %,
8.5≤Mn<10.0 mass %,
2.5≤Mo<4.0 mass %,
0.01≤Si<0.50 mass %,
0.01≤Nb<0.30 mass %, and
0.0001≤(Al, Mg, Ca)<0.01 mass %, and
at least one selected from 0.0001≤B<0.03 mass % and 0.0001≤Zr<0.1 mass %,
with the balance being Fe and unavoidable impurities;
the heat-resistant steel for exhaust valves satisfying 0.02≤Nb/C≤0.61 and 4.5≤Mo/C≤8.0.

8. The heat-resistant steel according to claim 7, which satisfies 5.2≤Mo/C≤8.0.

* * * * *